United States Patent [19]

Genakis

[11] 4,164,857

[45] Aug. 21, 1979

[54] PLUGLESS PIN TUMBLER CYLINDER

[76] Inventor: Joseph M. Genakis, 948 W. Boylston St., Worcester, Mass. 01606

[21] Appl. No.: 785,655

[22] Filed: Apr. 7, 1977

[51] Int. Cl.[2] ..... E05B 19/00; E05B 21/00; E05B 35/04

[52] U.S. Cl. ..... 70/352; 70/387; 70/395

[58] Field of Search ..... 70/350, 352, 387, 395, 70/399, 364 R, 364 A

[56] References Cited

U.S. PATENT DOCUMENTS

| | | | |
|---|---|---|---|
| 1,234,369 | 7/1917 | Mentzer | 70/395 |
| 1,527,336 | 2/1925 | Voda | 70/387 |
| 1,758,620 | 5/1930 | Rebori | 70/350 |
| 2,003,086 | 5/1935 | Liss | 70/364 R |
| 2,505,494 | 4/1950 | Heyer | 70/352 |
| 2,620,645 | 12/1952 | Levene | 70/352 |
| 3,640,107 | 2/1972 | Litvin | 70/352 |
| 3,780,548 | 12/1973 | Anestasov | 70/352 |
| 4,006,615 | 2/1977 | Szova | 70/395 |

*Primary Examiner*—Robert L. Wolfe
*Attorney, Agent, or Firm*—John E. Toupal

[57] ABSTRACT

A cylinder which does not have a plug but has selectors and cooperating pin tumblers controlled thereby under influence of a key which is thrust rectilinearly into the key way and which selectors are actuated by a bolt or the like.

7 Claims, 34 Drawing Figures

PLUGLESS PIN TUMBLER CYLINDER

BACKGROUND OF THE INVENTION

There have been many pick resistant cyclinders made but most are based around the pin tumbler cylinder construction in which a rotary plug has pin portions which are located in a key way where they cen be felt and manipulated by a pick or the like seeking to raise the pins to a common shear point level.

It is the purpose of the present invention to provide a cylinder which does not have a plug and in which the pins in their pinways have portions in the key way but not subject to divisions in a manner to allow the cylinder to be easily picked.

SUMMARY OF THE INVENTION

A cylinder is provided in which there is a cylinder body containing pin tumbler controlled selectors under spring pressure and which may be moved under certain conditions by a bolt or the like to locking or unlocking positions.

A series of pins in their pinways are provided and some may have rounded lower ends for positioning by the key, whereas others may be chiseled edge shaped and are provided with means whereby they easily rotate so that it will be difficult to be correctly positioned by a picking instrument and only will they be correctly raised and positioned by the key.

The cylinder selectors are provided with fins which extend longitudinally along opposite edges thereof with indentations therein for accepting or not accepting the pins depending upon the location or setting of the pins in the pinways.

The pin tumblers have designated deeper cut levels and shallow fake cuts determining the acceptance or non-acceptance of the selectors. This precludes a common shear level and substitutes a complicated system of many shear levels. The pins must be lifted by a proper key in order to allow the selectors to be moved to opening position.

It has always been difficult to maintain a minimum clearance between the circumference of the plug body, the pins and the inside circumference of the cylinder housing in a standard pin tumbler cylinder as regards shear level. Many different adjoining pin surfaces have been used to effect cylinder smoothness and security for plug rotation but invariably at the expense of security. This plugless cylinder permits horizontal penetration of the selector fins through corresponding horizontal openings in the pins with a minimum of clearance which is not practical in plug type cylinders. This plugless cylinder permits individual meaningful key bittings in sequence whereas in many pin tumbler cylinders a sequence may be eliminated to assure security.

When the key is inserted into this plugless cylinder and the pins are lifted to certain predetermined positions, certain deep recesses in said pins will align with said fins and allow the cylinder selectors to be moved by a bolt or the like to a locking or unlocking position.

The chiseled end pins will tend to rotate under influence of a picking instrument so that they will be out of opening position where they cannot be aligned with the fins of the selectors. The tumbler pins have fake non-accepting shallow grooves and deeper cut grooves for fin acceptance. Such deeper cut grooves must be raised to fin level by proper key for selector penetration.

BRIEF DESCRIPTION OF THE FIGURES

FIG. 32 is sectional view of FIG. 33; and

PREFERRED EMBODIMENT OF THE INVENTION

Figure 23:
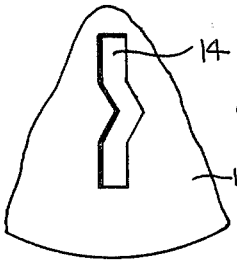
FIG. 23 illustrates a single key way.

A cylinder 10 has an end plate 12 with a double key way 14. This key way is to accommodate the key which is shown in FIGS. 18, 19, 20 and 21. This key operates only in a rectilinear manner without turning to accomplish its function. The key comprises a plate 16 having a rotary trough-like member 18 thereon, this member having two sides 20 and 22, each of the sides comprising a side of the trough and having a different configuration. It is to be noted, however, the same invention can be applied to a single key with a single key way 14 as shown in FIG. 23.

The key plate 16 is provided with a spring pressed button lock 24. Normally the end of the bottom of the trough at 18 impinges upon this pin as shown in FIGS.

18 and 20, but the trough is mounted on a pivot 26 and can turn 180° upon depression of the pin lock to release it. The purpose of this construction is to permit the cylinder to be operated from either side.

Figure 3:
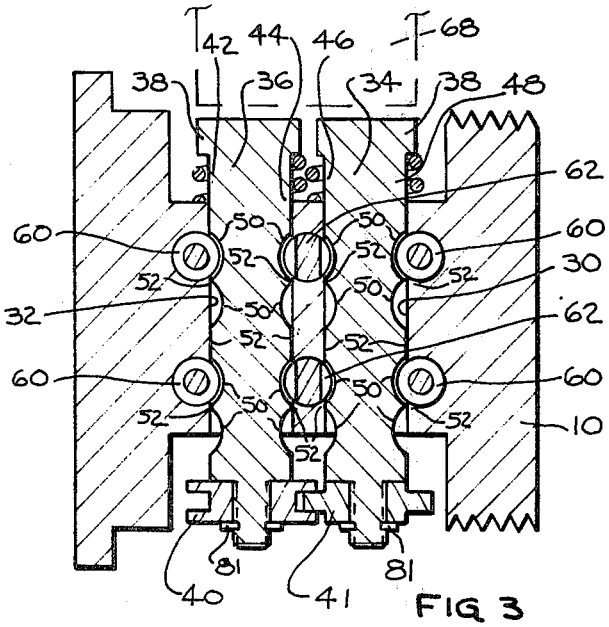
FIG. 3 is a section through the lock of FIGS. 1 and 2 illustrating the selector in optional locked or unlocked condition depending on usage or installation.
Figure 4:
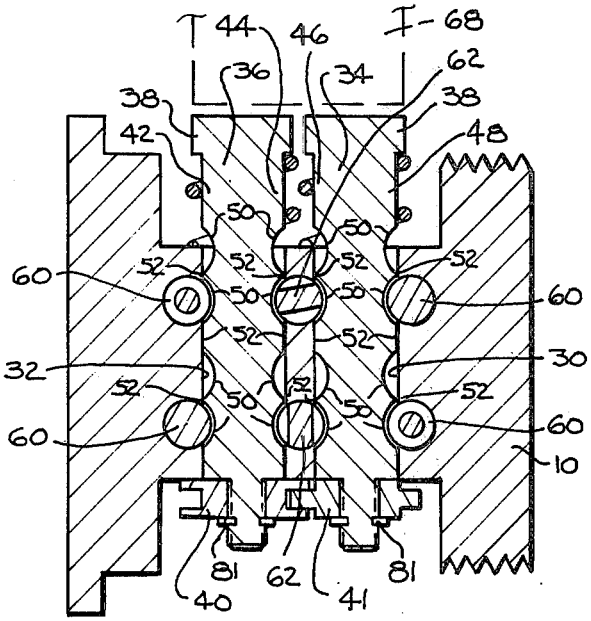
FIG. 4 is a similar view illustrating the selector in optional locked or unlocked condition depending on usage or installation.
Figure 25:
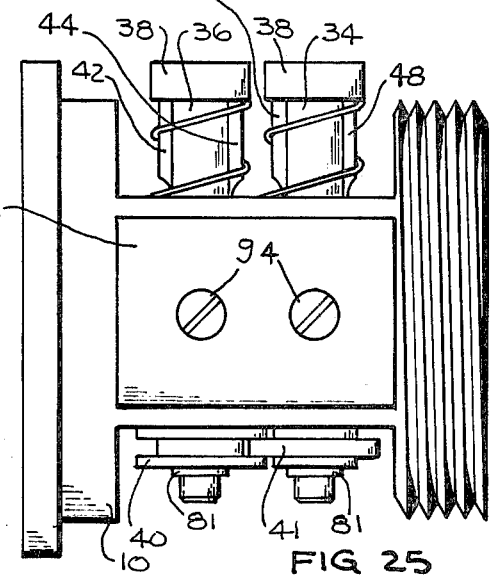
FIG. 25 is a top plain view of the cylinder of FIG. 1.

The housing 10 is provided with a pair of passages 30, 32 as in FIG. 3 for the sliding reception of a pair of cylindrical members (selectors) generally indicated at 34 and 36. These members at one end are provided with heads 38 which are spring pressed as shown in FIGS. 3, 4 and 25, to a normal position shown in FIG. 4 which may be the cylinder locking position. In this particular installation the cylinder cannot be opened with these selector members 34 and 36 in the FIG. 4 position; they have to be moved to the FIG. 3 position as shown.

Figure 8:
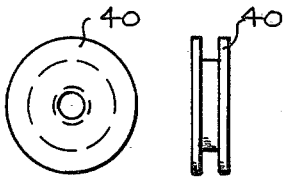
FIG. 8 is two views illustrating the connecting heads for said selectors.
Figure 9:
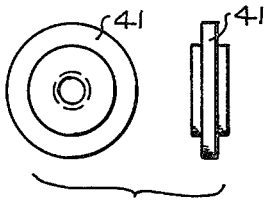
FIG. 9 is a similar view illustrating the other interlocking means for connecting the selectors to move simultaneously.

At the opposite ends thereof the selectors are provided with interlocking interconnecting means 40 as shown in FIG. 8 and 41 as shown in FIG. 9, mounted as clearly shown to interengage as in FIGS. 3 and 4 so that the selectors travel simultaneously. Each of the selector members 34 and 36 are provided with diametrically opposed longitudinally extending fins 42, 44, 46 and 48 and these fins are provided with indentations 50, see particularly FIGS. 5 and 6. Between the indentations 50 there are projections 52.

Figure 12:
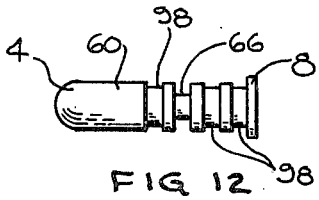
Figure 13:
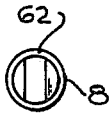
FIGS. 13, 14 and 15 show three views of a chiseled end pin with false shallow grooves and deeper cut grooves for selector fin acceptance.
Figure 14:
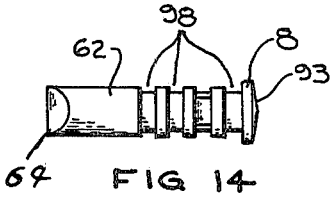
Figure 16:
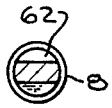
FIG. 16 is a section on line 16—16 of FIG. 15.
Figure 15:
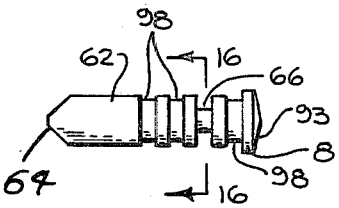

Referring now to FIGS. 11 to 17 inclusive there are shown details of the pins and their relationship with respect to the selectors 34 and 36. In the absence of the key aligning the pins as shown in FIG. 4, the center pin 62 will tend to rotate in their pin ways especially under the influence of a picking instrument. The essential features, however, of the pins 60 and 62 are that they have reduced portions 66 as shown in FIGS. 12, 14 and 15 and it is only when the reduced portions coincide with the fins 42, 44, 46 and 48 that the selectors can be moved longitudinally as for instance under actuation by a bolt 68 or the like, FIG. 4. This bolt may be any means desired but it is normally a hand operated bolt. With the pins 60 and 62 not in their proper position the selectors 34 and 36 cannot be moved longitudinally and it is only under the influence of the key 16 that the pins are placed in their correct position for allowing a motion of the bolt 68 to move the selectors 34 and 36 into a cylinder unlocking position.

Figure 26:
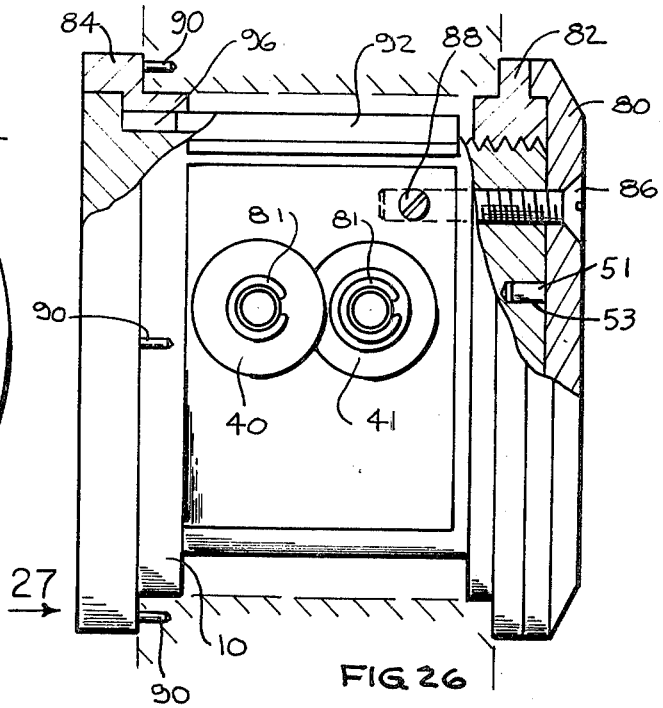
FIG. 26 is a view similar to FIG. 1, but with securing or installation hardware, in section for clarification shown in FIGS. 28, 29, 30, 31, 32 and 33.

Referring now to FIG. 26 showing the end plates 80, screw ring 82 and at the other end of the cylinder the ring 84, it will be seen that a screw 86 can be utilized from an exterior position to secure the cylinder in a certain desired position in the mortise and this screw can be locked by another locking screw 88 which can be reached through a bolt opening hole. The ring 84 is provided with pins 90 for taking into the wood as shown in FIG. 26 to hold the cylinder in position.

Figure 2:
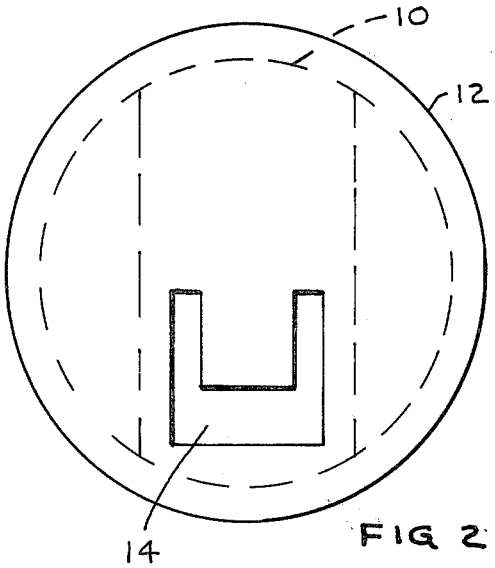
FIG. 2 is an end view thereof looking in the direction of arrow 2 in FIG. 1.
Figure 1:
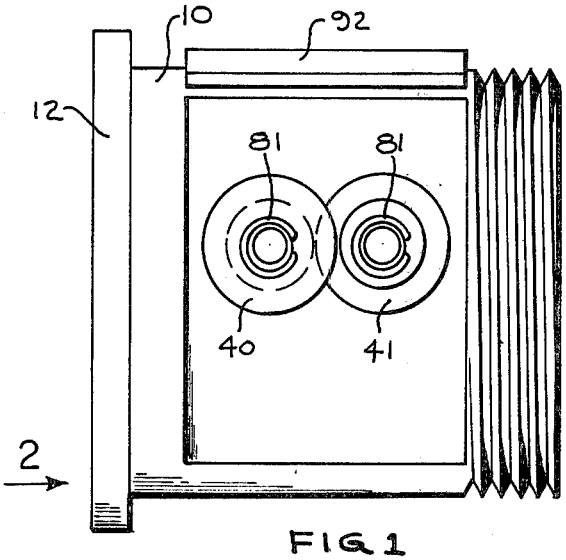
FIG. 1 is a view in side elevation showing the cylinder in assembled relation.
Figure 5:
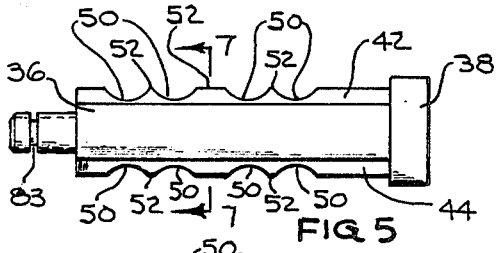
FIGS. 5 and 6 are elevational views showing the main body portion of the selectors.
Figure 7:
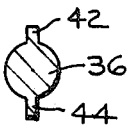
FIG. 7 is a section on line 7—7 of FIG. 5.
Figure 6:
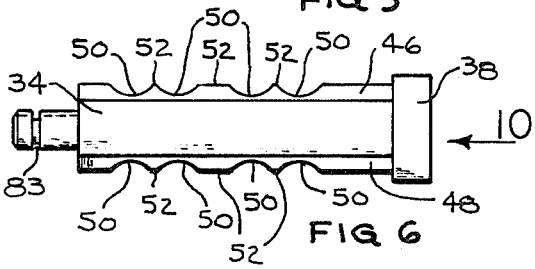
Figure 10:
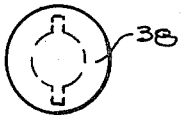
FIG. 10 is a view in elevation looking in the direction of arrow 10 in FIG. 6.
Figure 11:
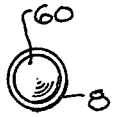
FIGS. 11 and 12 show ball end pins with false shallow grooves and deeper cut grooves for selector fin acceptance.
Figure 29:
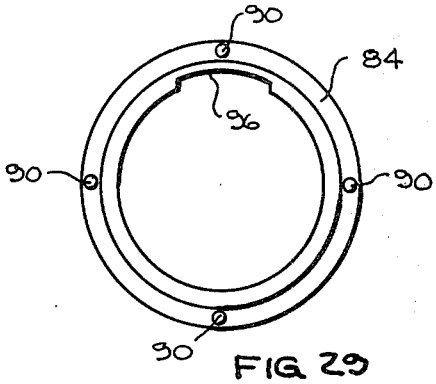
Figure 31:
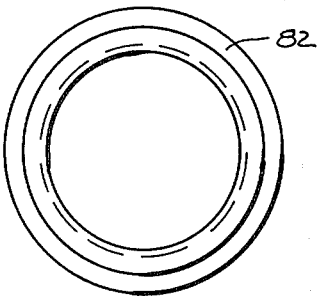
Figure 30:
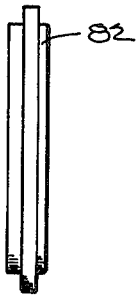

The cap 92 contains the pins and springs in pin ways as in FIGS. 1, 25 and 26. Screws 94 secure cap 92 in FIG. 25. Cut away area 96 in FIG. 29 slides over cap 92 which prevents it rotation. Shallow cuts 98 as shown in FIGS. 12, 14 and 15 are false or misleading indentations and will not permit the passing by of the selector fins 42, 44, 46 and 48. Indentations 50 as shown in FIGS. 5 and 6 permit free movement of pins 60 and 62 under the influence of a key when cylinder is in a unlocked position as shown in FIG. 4. Indentations 50 as shown in FIG. 3 will secure the tumbler pins 60 and 62 in an unlocked position after the key is removed and preclude any return of selectors 34 and 36 to a locked position as shown in FIG. 4. It will be necessary for bolt 68 to pressure selectors 34 and 36 to be able to insert the key for the return of selectors 34 and 36 to their initial position as in FIG. 4. FIG. 3 shows selector 34 and 36 in an unlocked position after key removal. FIG. 4 shows selectors 34 and 36 in a locked position after key removal. FIG. 4 shows pin 62 in a turned position precluding any possibility of selector fins 42, 44, 46 and 48 passing through a deep grooved cut setting. FIG. 3 shows pins 62 in proper relationship to selectors 34 and 36 and allowing passage of selectors, pproviding a key had raised the pins to their proper level of passage as in FIG. 17 as against a shallow or false indentation.

Figure 17:
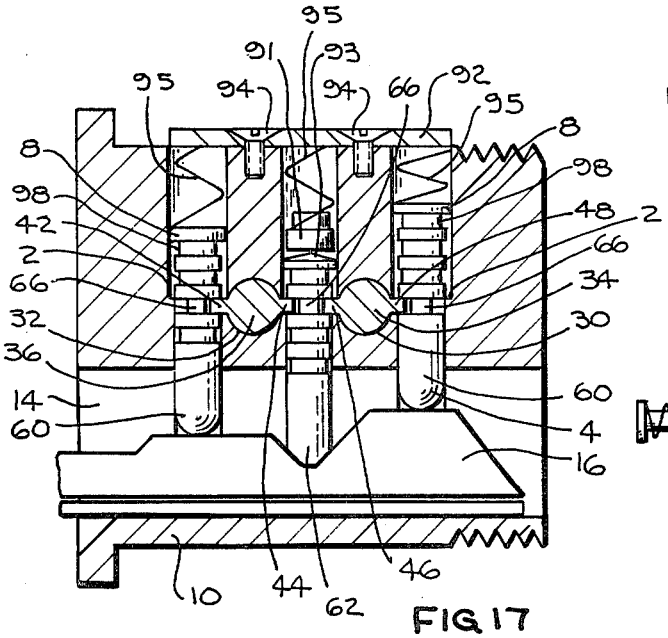
FIG. 17 is a sectional view illustrating a key in the key way positioning the pins and accommodating the fins of the selectors.
Figure 18:
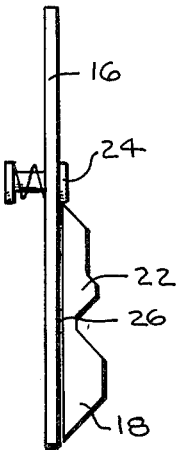
FIGS. 18, 19, 20 and 21 illustrate an optional type of key.
Figure 19:
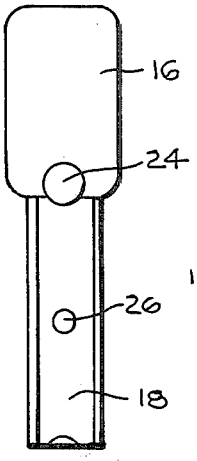
Figure 20:
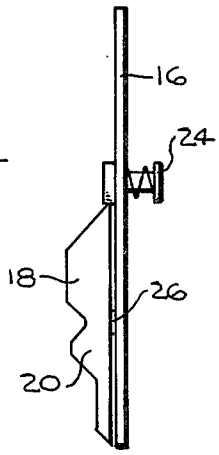
Figure 22:
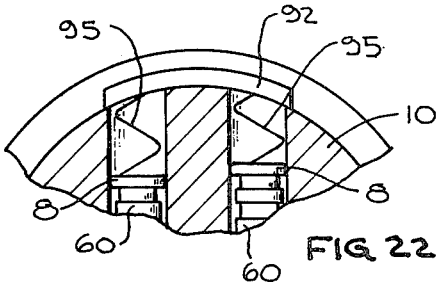
FIG. 22 is a traverse section of the spring pressured pins in pin ways with a positioning cover.
Figure 21:
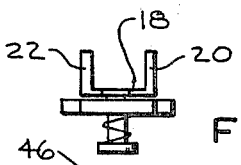

Spring pressure top pin 91 in FIG. 17 rides on conical surface 93 as shown in FIG. 14 thereby minimizing surface friction. Springs 95 as shown in FIG. 17 directly pressure pins 60. On pin 62 the spring first pressures top pin 91 which in turn continues pressure on pin 62.

Figure 24:
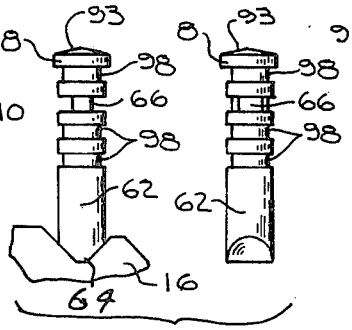
FIG. 24 illustrates the chisel pointed pin end and its interengagement with respect to key 16.
Figure 32:
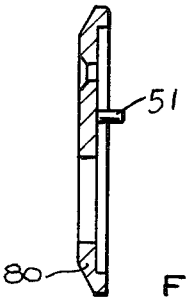
Figure 33:
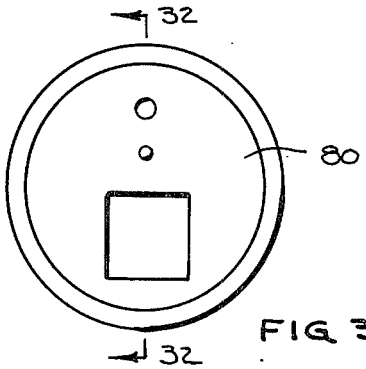

Retaining rings 81 as shown in FIG. 3 are positioned in grooves 83 in FIGS. 5 and 6 to secure interlocking interconnecting means 40 and 41 as shown in FIGS. 3 and 4 to selectors 34 and 36. This disclosure is not limited to the number of selectors or pins shown. Multiple selectors, more than two, in conjunction with multiple pin tumblers may be used in a cylinder. Tumbler pins may be all bottom rounded or conical shaped bottom or in different combinations. Tumbler pin 62 in FIG. 24 shows proper direction in relation to key 16. Tumbler pin 62 suspended in FIG. 24 along side key 16 shows a side view as well as one view of misalignment made possible by a picking instrument. Pin 51, FIG. 32, inserts into hole 53 in FIG. 26 and assists in preventing retation of ring 82 for illegal removal.

The selector 34 and 36 may be functional from either side of the cylinder body. There is no common shear point level in this plugless cylinder such as appears in a conventional plug cylinder. Due to the absence of a plug there are numerous shear levels permissible in a plugless cylinder because of the relationship of the selector fins to the pin tumblers and also the ever present possibility of turned chiseled ends pins induced by the action of a picking instrument precludes the possibility of a successful picking attempt. The tumbler pins may be cased hardened to prevent drilling. The larger diameter of pins 60 and 62 as shown in FIGS. 12, 14 and 15 as indicated by 8 in FIGS. 12, 14 and 15 will seat in pinways 2 as seen in FIG. 17 thereby preventing any bottom drilling of key way to drop pin tumblers and enhance illegal operation of cylinder.

Standard pin tumbler cylinder keys normally provide for about ten bitting depths for each pinway. Locksmiths, normally will allow at least two bitting depths when changing keys from previous settings. It appears that one bitting depth will approximate 0.015 which in the opinion of many locksmiths will not provide the necessary security level and therefore many locksmiths will allow at least two bitting depths on the key from a previous setting.

In a six pin tumbler cylinder multiplying bittings 10 $\times$ 10, six times will amount to one million bittings but in view of allowing at least two bittings of this amount of one million bittings is substantially reduced.

Because of the construction of a plugless cylinder, of about the same diameter as a standard pin tumbler cylinder, and using six tumbler pins, it is possible to increase over eleven fold the amount of good bittings as compared to a standard cylinder. When the diameter of a plugless cylinder is increased the number of possible bittings increase dramatically.

If for example a triple key way system were used and 35 bittings per pin tumbler were used and a total of twelve pin tumblers, 4 pin tumblers per row, the amount of security keys possible without duplication reaches astronomical figures.

In a plugless cylinder equipped with multiple chiseled end pin tumblers, only one pin tumbler out of its proper line of direction in relation to selector fin can negate a picking attempt by obstructing longitudinal movement of all selectors.

The length of the tumbler pins will be of such length and construction that at no time will the selectors and their fins be allowed to move longitudinally without being in the area of the circumference of the pin tumbler, not including the reduced area of the bottom pin tumblers 4 and 64 in FIGS. 12 and 14 or the enlarged area of the top of the pin tumblers 8 as in FIG. 12.

The enlarged area of pin tumblers 8 as shown in FIG. 12 will stop and rest in seat 2 as shown in FIG. 17.

Figure 27:
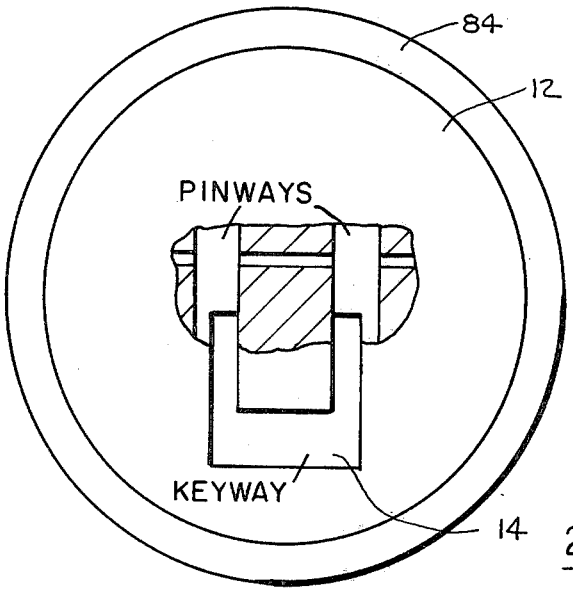
FIG. 27 is a view in elevation, showing pin ways off center in relation to key ways, looking in the direction of arrow 27 in FIG. 26.

FIG. 27 shows off centered key way 14 in relation to center of pinway holes.

Figure 34:
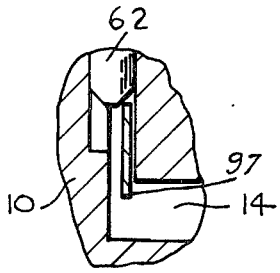
FIG. 34 shows pick 97 and turned pin 62.
Figure 28:
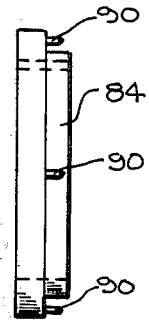
FIGS. 28, 29, 30, 31, 32 and 33 are detailed views of various rings and end plates with pertinence to the cylinder.

Reference 14 in FIG. 34 shows action and possible result of turned pin 62 by action of a pick 97 in an off centered key way.

I claim:

1. A plugless cylinder lock comprising:

a lock housing means defining a plurality of parallel pinways and a keyway communicating therewith;

a locking selector rectilinearly movable in said housing between open and closed positions in a direction transverse to said pinways;

a pin disposed in each of said pinways and each movable from locking positions to a selective release position by engagement with a properly bitted key in said keyway, said housing means preventing movement of said pins in the direction of movement of said selector, and said pins and said selector being shaped and arranged to engage and prevent said movement of said selector with said pins in said locking positions and to disengage so as to permit said movement of said selector with said pins in said release positions, said pins and said selector being further shaped and arranged to engage in response to movement of said selector out of said open position and thereby prevent said movement of said pins; and means for moving said selector into said open position upon insertion of a proper key in said keyway.

2. The plugless cylinder of claim 1 wherein said engagement between said pins and said selector in response to movement of said selector out of said closed position occurs along substantially planar surfaces.

3. The plugless cylinder of claim 2 wherein said selector comprises an elongated body portion and fin portions extending therefrom, each of said pins comprise cylindrical surfaces interrupted by a plurality of spaced apart slots substantially parallel to said fins, and said engagements occur between said fin portions and said slots.

4. The plugless cylinder of claim 3 wherein said slots extend around the entire periphery of said pins.

5. The plugless cylinder of claim 3 wherein said slots in each of said pins comprise one slot of a depth that accommodates movement therethrough of said fin portions and other slots of a lesser depth that prevents movement therethrough of said fin portions.

6. The plugless cylinder of claim 1 wherein said housing retains a pair of said selectors that straddle and engage said plurality of pins.

7. The plugless cylinder of claim 6 wherein said slots extend around the entire periphery of said pins.

* * * * *